US011085207B2

(12) United States Patent
King et al.

(10) Patent No.: US 11,085,207 B2
(45) Date of Patent: Aug. 10, 2021

(54) THEFT DETERRENT SYSTEM FOR ELECTRONICS CABINET DOOR

(71) Applicant: CommScope Technologies LLC, Hickory, NC (US)

(72) Inventors: Alfred W. King, Allen, TX (US); Carmen M. Stevenson, Cumby, TX (US); Stephen P. Watson, Richardson, TX (US); Komen Shliker, Plano, TX (US); Wade J. Womack, Allen, TX (US)

(73) Assignee: CommScope Technologies LLC, Hickory, NC (US)

( * ) Notice: Subject to any disclaimer, the term of this patent is extended or adjusted under 35 U.S.C. 154(b) by 144 days.

(21) Appl. No.: 16/402,274

(22) Filed: May 3, 2019

(65) Prior Publication Data

US 2019/0338559 A1 Nov. 7, 2019

Related U.S. Application Data

(60) Provisional application No. 62/666,814, filed on May 4, 2018.

(51) Int. Cl.

| | |
|---|---|
| ***E05B 67/38*** | (2006.01) |
| ***E05B 1/00*** | (2006.01) |
| ***E05B 9/08*** | (2006.01) |
| ***E05B 65/06*** | (2006.01) |
| ***E05B 9/00*** | (2006.01) |

(52) U.S. Cl.

CPC ..... *E05B 67/38* (2013.01); *E05B 1/0061* (2013.01); *E05B 9/002* (2013.01); *E05B 9/08* (2013.01); *E05B 65/06* (2013.01); *E05B 2009/004* (2013.01)

(58) Field of Classification Search

CPC ..... E05B 1/0061; E05B 1/04; E05B 9/002; E05B 9/08; E05B 2009/004; E05B 65/06; E05B 67/22; E05B 67/38; E05B 67/383; E05B 2067/386

See application file for complete search history.

(56) References Cited

U.S. PATENT DOCUMENTS 3,623,346 A * 11/1971 Durtin ..... E05B 17/142 70/424
4,238,941 A * 12/1980 Halopoff ..... E05B 67/38 70/417
4,285,221 A * 8/1981 Atchisson ..... E05B 13/001 70/232
4,876,867 A * 10/1989 Leneave ..... E05B 13/001 70/420
4,882,918 A * 11/1989 Stanich ..... E05B 67/02 70/54

(Continued)

*Primary Examiner* — Christopher J Boswell
(74) *Attorney, Agent, or Firm* — Myers Bigel, P.A.

(57) ABSTRACT

A theft deterrent system for an electronics cabinet includes a handle cover having through-holes dimensioned to align with a through-hole in a handle of the electronics cabinet. The through-holes of the handle cover may be dimensioned to receive a shackle of a lock. The theft deterrent system further includes a shackle cover dimensioned to receive the shackle of the lock. The shackle cover may include an upper tab and a lower tab, each comprising a respective shackle slot therein dimensioned to receive the shackle of the lock.

18 Claims, 15 Drawing Sheets

(56) References Cited

U.S. PATENT DOCUMENTS

| | | | | | |
|---|---|---|---|---|---|
| 5,146,771 | A * | 9/1992 | Loughlin | E05B 67/38 | 70/417 |
| 5,477,710 | A * | 12/1995 | Stefanutti | E05B 67/38 | 70/417 |
| 5,924,314 | A * | 7/1999 | Cernansky | E05B 17/2084 | 70/232 |
| 5,975,595 | A * | 11/1999 | Lorenzo | E05B 67/38 | 292/205 |
| 7,003,989 | B2 * | 2/2006 | St. James | E05B 67/38 | 70/54 |
| 10,519,696 | B2 * | 12/2019 | Haber | E05B 67/22 | |

* cited by examiner

THEFT DETERRENT SYSTEM FOR ELECTRONICS CABINET DOOR

CROSS-REFERENCE TO RELATED APPLICATIONS

The present application claims priority under 35 U.S.C. § 119 to U.S. Provisional Application No. 62/666,814, filed on May 4, 2018, and entitled "THEFT DETERRENT SYSTEM FOR ELECTRONICS CABINET DOOR," the entire contents of which are hereby incorporated by reference as if set forth herein.

TECHNICAL FIELD

The present disclosure relates generally to cabinets, and more specifically to electronics cabinets.

BACKGROUND

Outdoor electronic cabinets have become popular in recent years. They can protect a wide range of electronic equipment including radios, multicarrier power amplifiers (MCPA), power supplies, batteries, and wireless cell site backhaul equipment. These cabinets can protect base station equipment from environmental conditions while minimizing operating expenses and energy consumption.

Typically, electronics cabinets include one or two doors mounted to the front of the cabinet to provide access to components positioned within the front portion of the cabinet.

Unfortunately, electronics cabinets are often targets for theft and vandalism, with batteries being a particularly attractive commodity. As such, locking systems that prevent unwanted access to an interior of an electronics cabinet are desirable.

SUMMARY

The present disclosure provide aspects for providing security to cabinets, including electronics cabinets. Some aspects of the present disclosure provide a theft deterrent system, with the theft deterrent system including a handle cover having through-holes dimensioned to align with a through-hole in a handle of an electronics cabinet. The handle cover is adapted to at least partially cover the handle, and the through-holes of the handle cover are dimensioned to receive a shackle of a lock. The theft deterrent system also includes a shackle cover dimensioned to receive the shackle of the lock. The shackle cover includes an upper tab and a lower tab, each including a respective shackle slot therein dimensioned to receive the shackle of the lock.

Some aspects of the present disclosure systems provide methods of securing an electronics cabinet. For example, a method may include aligning through-holes in a handle cover with a through-hole in a handle of an electronics cabinet, where the handle cover is adapted to at least partially cover the handle; inserting a shackle of a lock through the through-holes in the handle cover and the through-hole in the handle of the electronics cabinet; locking the lock; and positioning the lock in an opening of the handle cover.

Some aspects of the present disclosure provide a shackle cover having a unitary body including an upper tab and a lower tab, each including a respective shackle slot therein dimensioned to receive a shackle of a lock. The shackle cover may include a through-hole in the lower tab dimensioned to receive the shackle of the lock. The shackle cover may have outer walls dimensioned such that a height of the shackle cover along the outer walls is greater than a height of the shackle cover at the upper tab.

Some aspects of the present disclosure provide a system that includes an electronics cabinet. The system also includes a handle cover including through-holes dimensioned to align with a through-hole in a handle of the electronics cabinet, with the handle cover adapted to at least partially cover the handle, and with the through-holes of the handle cover dimensioned to receive a shackle of a padlock. The system also includes a shackle cover dimensioned to receive the shackle of the padlock. The shackle cover may include an upper tab and a lower tab, each including a respective shackle slot therein dimensioned to receive the shackle of the padlock.

DETAILED DESCRIPTION

Figure 1:
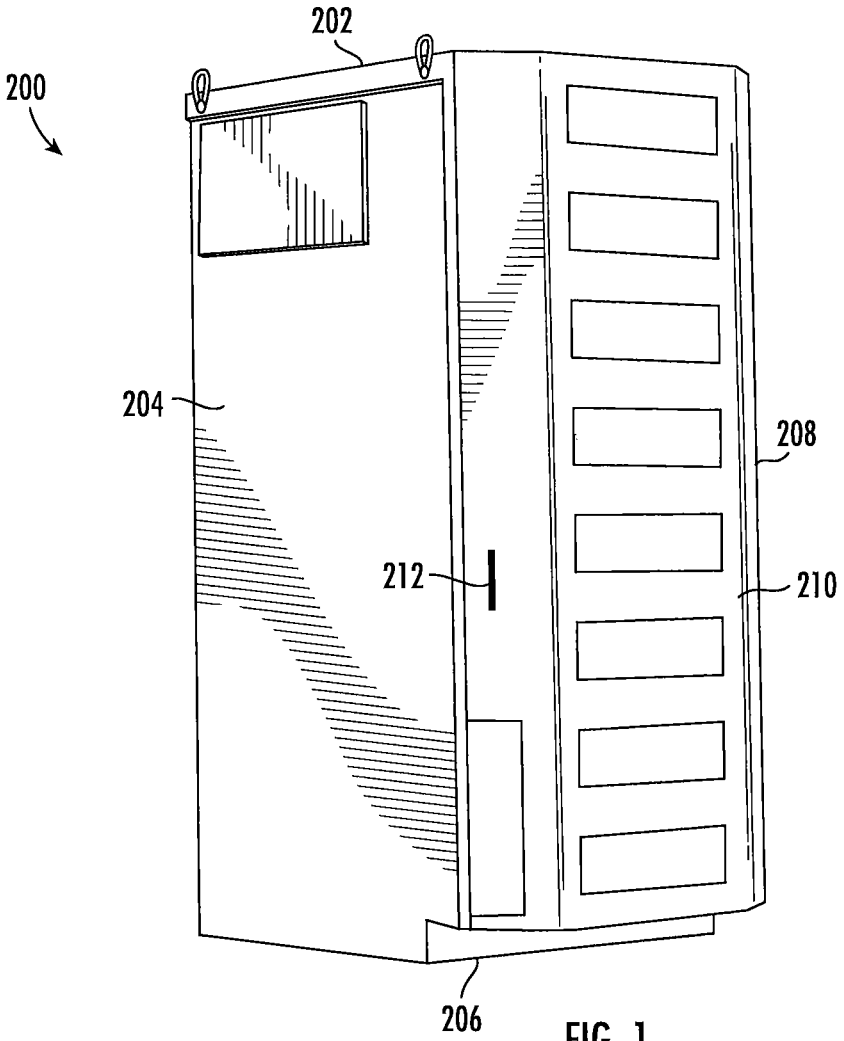
FIG. 1 PRIOR ART
FIG. 1 is a perspective view of a conventional electronics cabinet.

The inventive concepts provided in the present disclosure are described more fully hereinafter with reference to the accompanying drawings, in which embodiments of the inventive concepts are shown. These inventive concepts may, however, be embodied in many different forms and should not be construed as limited to the embodiments set forth herein; rather, these embodiments are provided so that this disclosure will be thorough and complete, and will fully convey the scope of the inventive concepts to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the inventive concepts. Unless otherwise defined, all terms (including technical and scientific terms) used herein have the same meaning as commonly understood by one of ordinary skill in the art to which these inventive concepts belong. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper," "lateral," "left," "right," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

Referring now to the drawings, a conventional electronics cabinet, designated broadly at 200, is shown in FIG. 1. The cabinet 200 may be generally box-shaped, with a ceiling 202, side walls 204, a floor 206 and a front wall 208 that may be, or may include, a door 210. The door 210 may be hinged to swing out from the interior cavity (not shown) of the cabinet 200, or may be a removable panel. The door 210 may be manipulated via a handle 212. Manipulation of the handle 212 (e.g., by rotating, pulling, pushing, or the like) may result in a corresponding movement of one or more latches (not shown) that engage with a wall 204 or other portion of the cabinet 200, allowing for the door 210 to swing about its hinges or to be removed, as the case may be.

In some cabinets, the handle 212 may be arranged in a pocket formed in the door 210. The pocket may protect the handle from environmental conditions that may degrade the handle or latches (e.g., oxidation). A pocket 214 of a cabinet 200 may be best seen in FIGS. 10-12.

The handle 212 may include one or more features (not shown) designed to restrict unwanted access to cabinet 200. One common example is the inclusion of a keyway (or keyhole) on or near the handle 212. Another example of a feature includes providing one or more through-holes in the handle 212, which are dimensioned to receive a shackle of a padlock.

Figure 2:
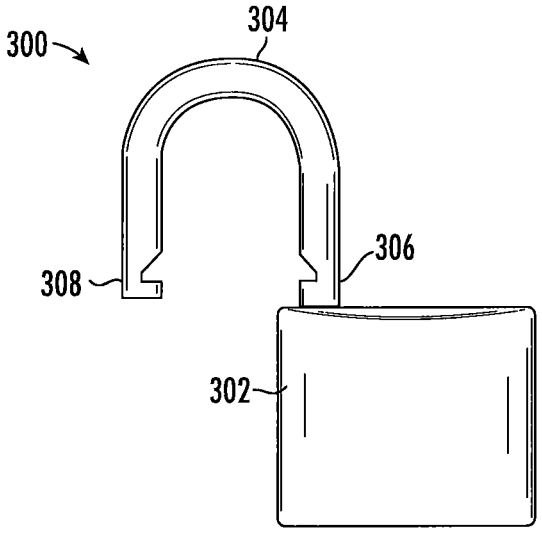
FIG. 2 PRIOR ART
FIG. 2 is a front view of a conventional padlock used to secure the electronics cabinet of FIG. 1.

A conventional padlock is as shown in FIG. 2. A padlock 300 may include a body 302 in which a locking mechanism (not shown) is disposed, and a shackle 304. The shackle 304 may include a shackle heel 306, which is typically coupled to the body 302 in a more permanent fashion, and a shackle toe 308, which may be releasably engaged with the body 302 and the locking mechanism therein. In some padlocks 300, the body 302 may be rotatable about the shackle heel 306 when the shackle toe 308 is not engaged. In some padlocks 300, the shackle 304 may be completely detachable from the lock body 302. The inventive concepts provided in the present disclosure may be used with padlocks or locks having any type of shackle 304, and those explicitly recited herein are provided for context, and not as limitations on the scope of the present disclosure.

The locking mechanism of the padlock 300 may be locked and unlocked, and, correspondingly, the shackle 304 or shackle toe 308 thereof may be engaged or disengaged, via one or more actions. For example, a key may be inserted into a keyway located on a side of the lock body 302 (such as the side opposite the shackle 304). As another example, a codephrase (e.g., alphanumeric or numeric combination) may be entered using one or more rotating dials. More recently, a signal may be transmitted to a receiver within the lock body from a remote device (e.g., via a signal transmitted using BLUETOOTH, WI-FI, or other communication protocol). The inventive concepts provided in the present disclosure may be used with padlocks or locks having any type of locking mechanism, and those explicitly recited herein are provided for context, and not as limitations on the scope of the present disclosure.

Conventionally, installation of a lock (e.g., padlock 300) onto a cabinet (e.g., cabinet 200) is as follows. The lock may be unlocked, disengaging the shackle toe 308 from the padlock body 302. The shackle toe 308 may be then fed through the receiving through-hole of the handle 212 of cabinet door 210, and then may be re-engaged with the padlock body 302 and the locking mechanism therein.

Although deployment of a padlock 300 prevents some instances of unwanted entry into the cabinet 200, padlocks 300 and cabinets 200 are susceptible to forced entry attack. Such forced entry attacks may be through using tools such as bolt cutters, chisels, hammers, drills, torches, pry bars or the like, and may permanently damage or destroy the padlock. In some situations, the handle 212 may be pried off of the cabinet 200, even when padlocked, and access to the latching mechanism coupled to the handle may be achieved, thus allowing opening of the door or door panel 210.

To address such attacks, the present disclosure provides systems and apparatuses that reduce access to a handle of an electronics cabinet 200 and/or to a padlock 300 attached to a handle 212 of an electronics cabinet 200.

Figure 5:
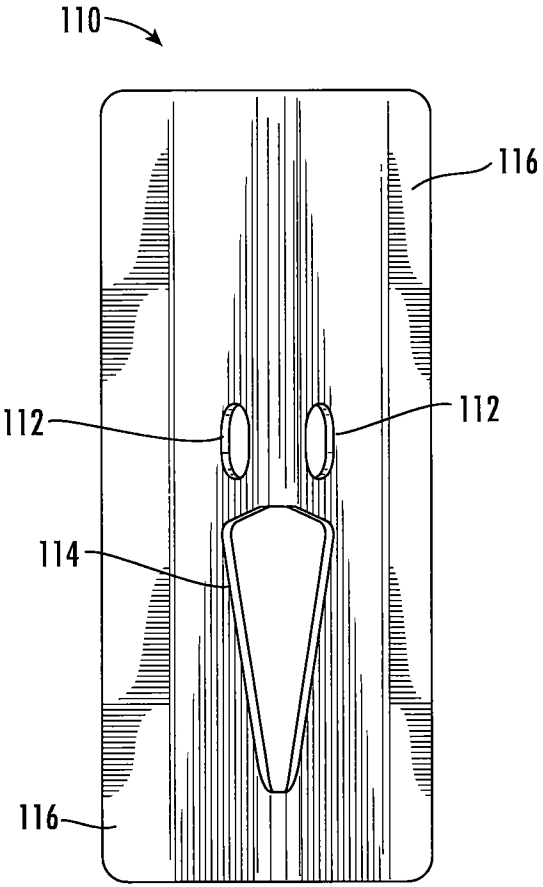
FIG. 5 is a front perspective view of the security system half shown in FIG. 3.
Figure 4:
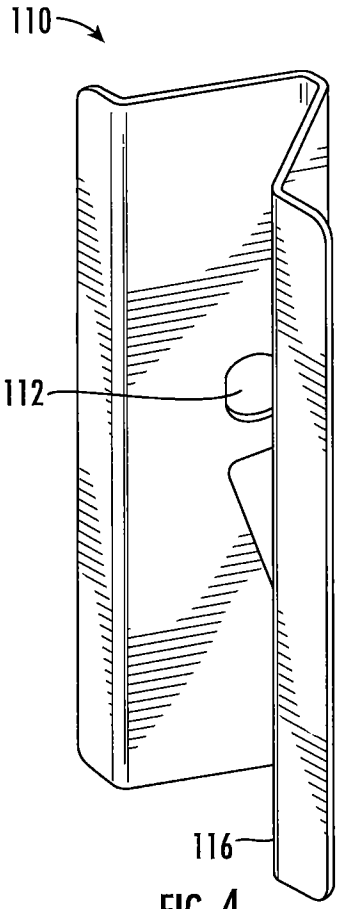
FIG. 4 is a rear isometric view of the handle cover of FIG. 3.
Figure 3:
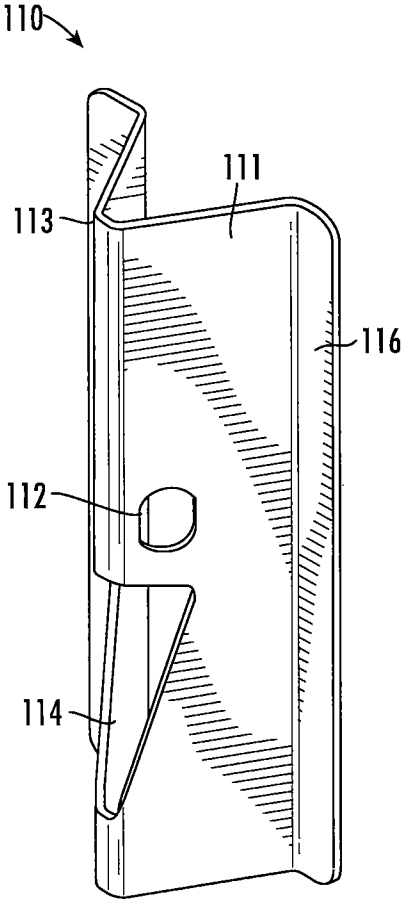
FIG. 3 is a front isometric view of a handle cover that is in accordance with the inventive concepts of the present disclosure.

FIG. 3 is a front isometric view of a handle cover 110 that is in accordance with the inventive concepts of the present disclosure. FIG. 4 is a rear isometric view of the handle cover 110 that is in accordance with the inventive concepts of the present disclosure. FIG. 5 is a front view of the handle cover 110 that is in accordance with the inventive concepts of the present disclosure.

The handle cover 110 may be manufactured as a unitary body using any suitable manufacturing process, and may be manufactured preferably of steel (e.g., 0.090 galvanized steel which in some embodiments may be powder coated), although other materials having contextually appropriate properties may be considered and utilized by those of skill in the art. The handle cover 110 may be substantially "V" shaped along its longitudinal or long axis, with the center portion 113 at the "bottom" of the "V" shape having a width (e.g., sidewalls 111 of the handle cover 110 may not share a common edge, but rather may be each adjacent to the center portion 113). Further, the handle cover 110 may have a pair of tabs 116 extending substantially parallel the center portion 113. A pair of through-holes 112 may be positioned roughly halfway along the long axis of the handle cover 110 and dimensioned to receive a shackle (e.g., the shackle 304 of the padlock 300). Further, an opening 114 may be positioned lower than the pair of through-holes 112 (when the handle cover 110 is viewed in a front view). The opening 114 may have outer edges which are angled with respect to the long axis of the handle cover 110, and the positioning and dimensioning of the opening 114 may be to receive a padlock 300 where the shackle 304 thereof is passed the through-holes 112 during installation of the padlock 300. As discussed further herein, the opening 114 may be dimensioned and positioned to receive a shackle cover (e.g., the shackle cover 150 shown in FIG. 6) installed around the padlock 300. The height of the handle cover 110 (that is, a dimension from the center portion 113 to a point level with the tabs 116 along an axis perpendicular to the long axis) may be dimensioned to receive a handle 212 of a cabinet within a channel between the sidewalls 111 of the handle cover 110, and may be further dimensioned so that tabs 116 will be flush with a surface of the cabinet 200 (e.g., door 210, front wall 208 and/or a surface of a pocket 214).

Installation of the handle cover 110 may proceed as follows. First, the handle cover 110 may be positioned such that the through-holes 112 of the handle cover 110 are aligned with the through-holes of the handle 212 of the cabinet 200. The handle cover 110 may be held in place during this operation (even though the handle cover 110 might not be affixed to the handle 212 or to a surface of the cabinet 200). Then, a shackle 304 of an unlocked padlock 300 may be fed through the through-holes 112 of the handle cover 110 and the through-holes of the handle 212 (e.g., through a first through-hole 112 of the handle cover 110, then the through-holes of the handle 212, then a second through-hole 112 of the handle cover 110). The padlock 300 may then be locked by engaging the shackle 304 with the padlock body 302 and the locking mechanism therein. The padlock 300 may then be lowered into position into the opening 114.

The handle cover 110, in view of its dimensioning such that the tabs 116 are flush with the surface of the cabinet 200 (e.g., door 210, front wall 208 and/or a surface of a pocket 214), and in view of its sidewalls 111 being dimensioned to receive the handle 212 in a channel therebetween, may prevent prying or other tampering with the handle 212 itself when the padlock 300 is installed. In this manner, the handle cover 110 may act as a theft deterrent by itself.

Figure 6:
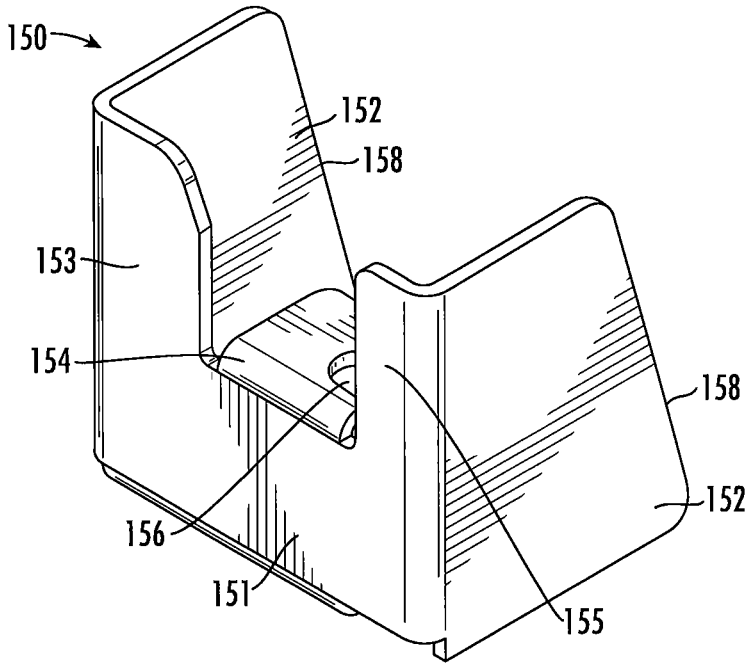
FIG. 6 is a right-front-top isometric view of a shackle cover.
Figure 7:
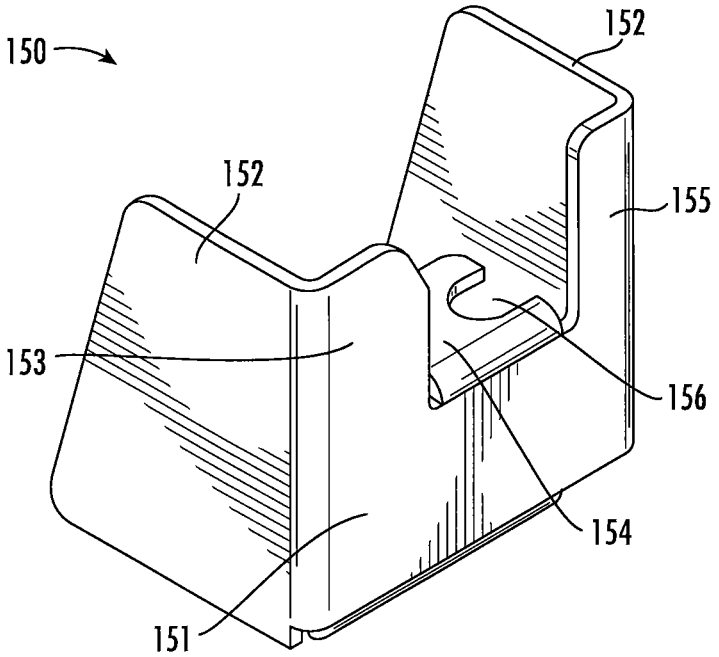
FIG. 7 is a left-front-top isometric view of the shackle cover of FIG. 5.
Figure 8:
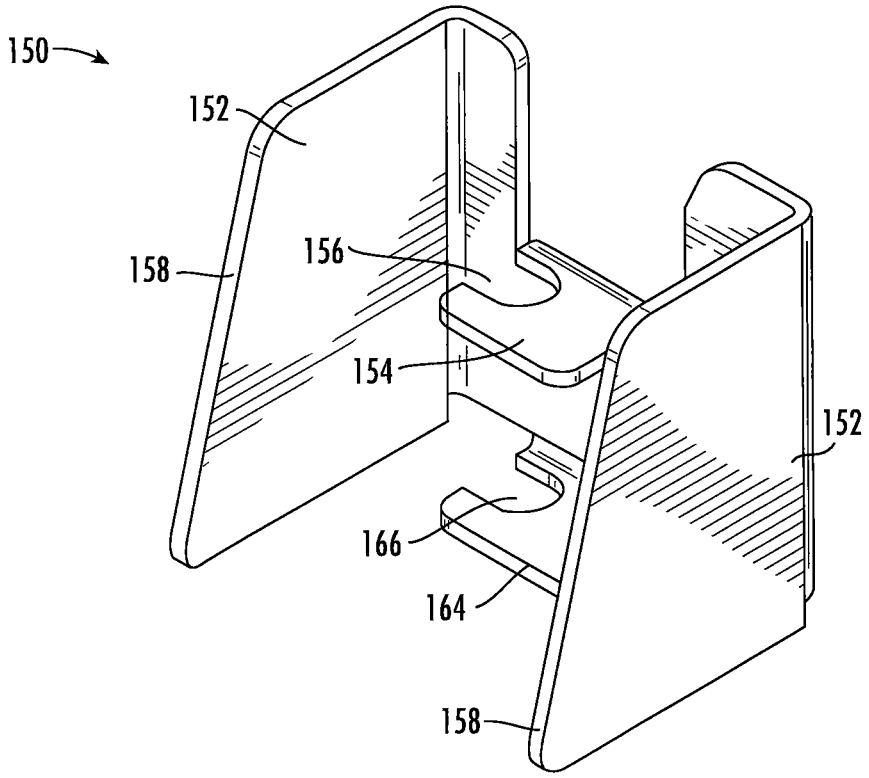
FIG. 8 is a back isometric view of the shackle cover of FIG. 6.
Figure 9:
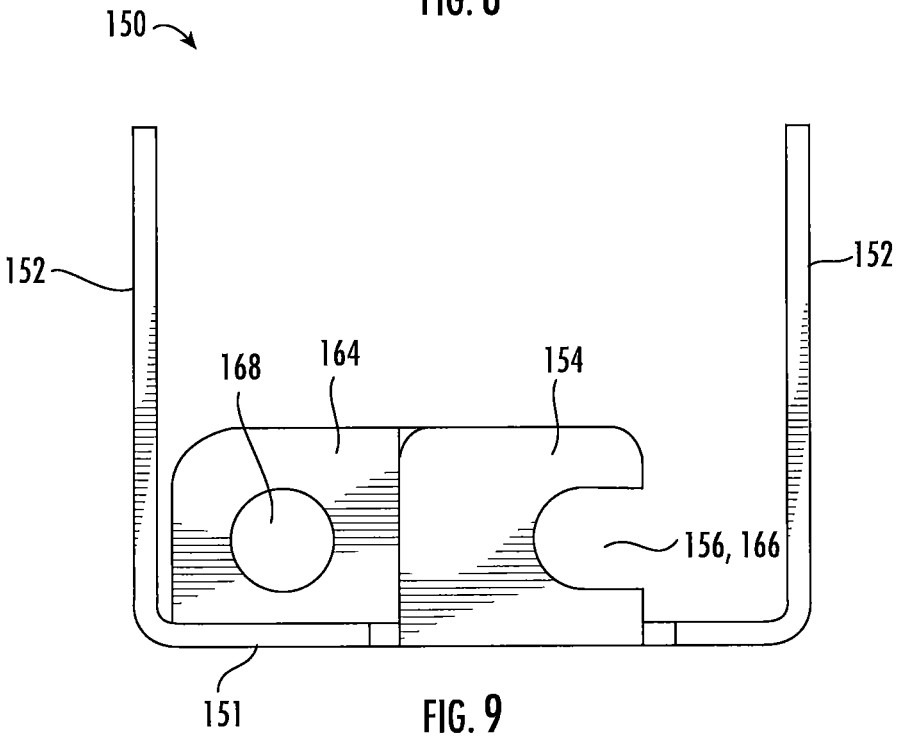
FIG. 9 is a top view of the shackle cover of FIG. 6.
Figure 10:
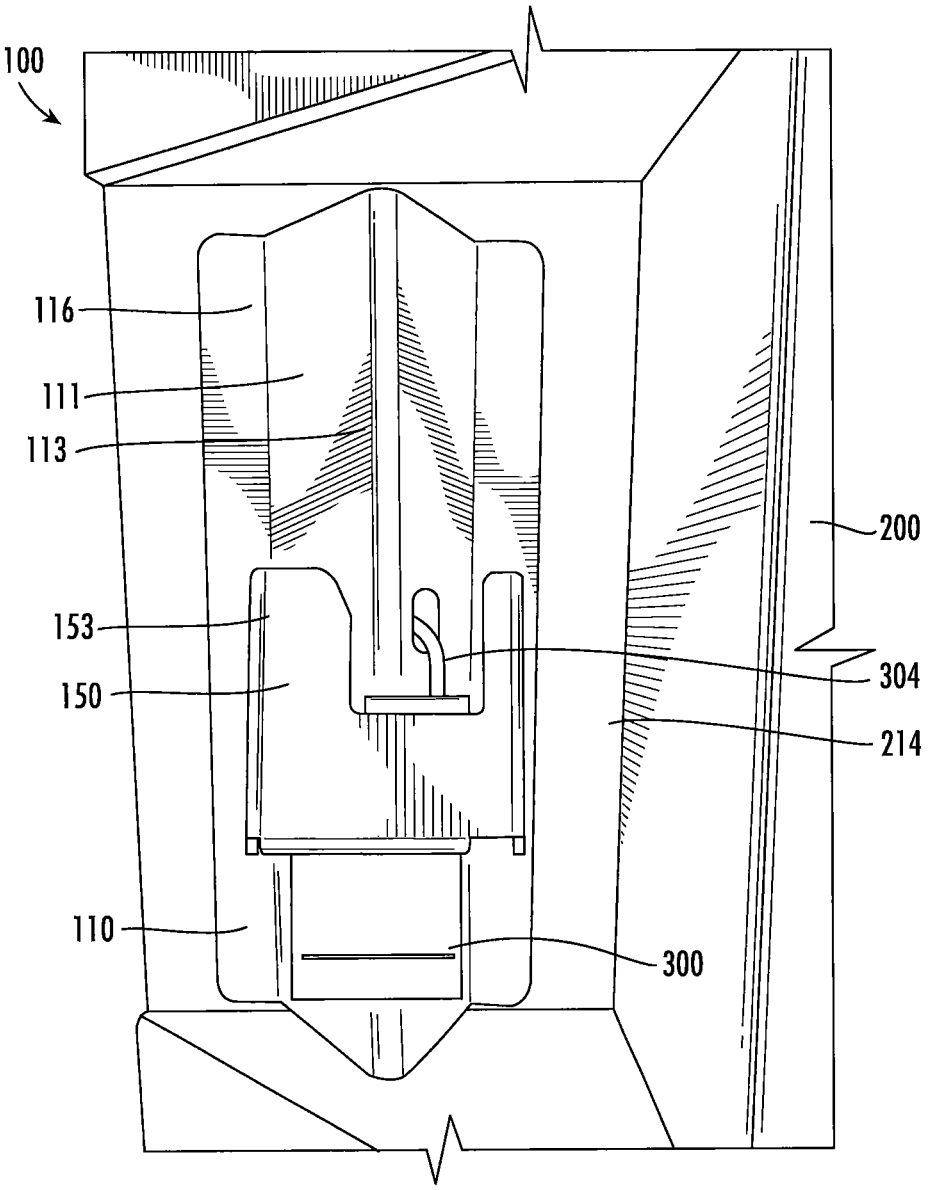
FIG. 10 is a front view of a theft deterrent system comprising a handle cover and a shackle cover, in accordance with the inventive concepts of the present disclosure.
Figure 11:
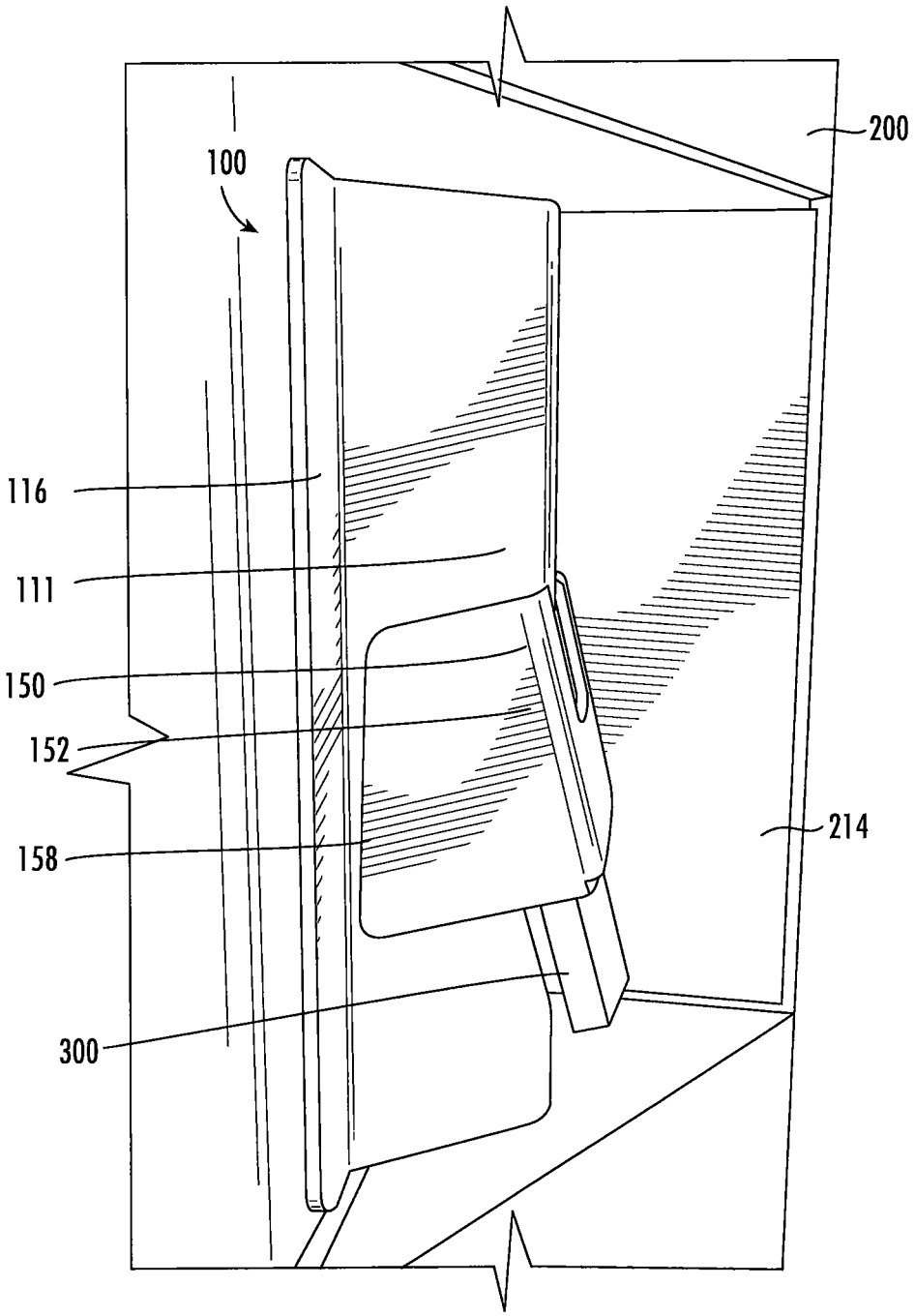
FIG. 11 is a side view of the theft deterrent system of FIG. 10.
Figure 12:
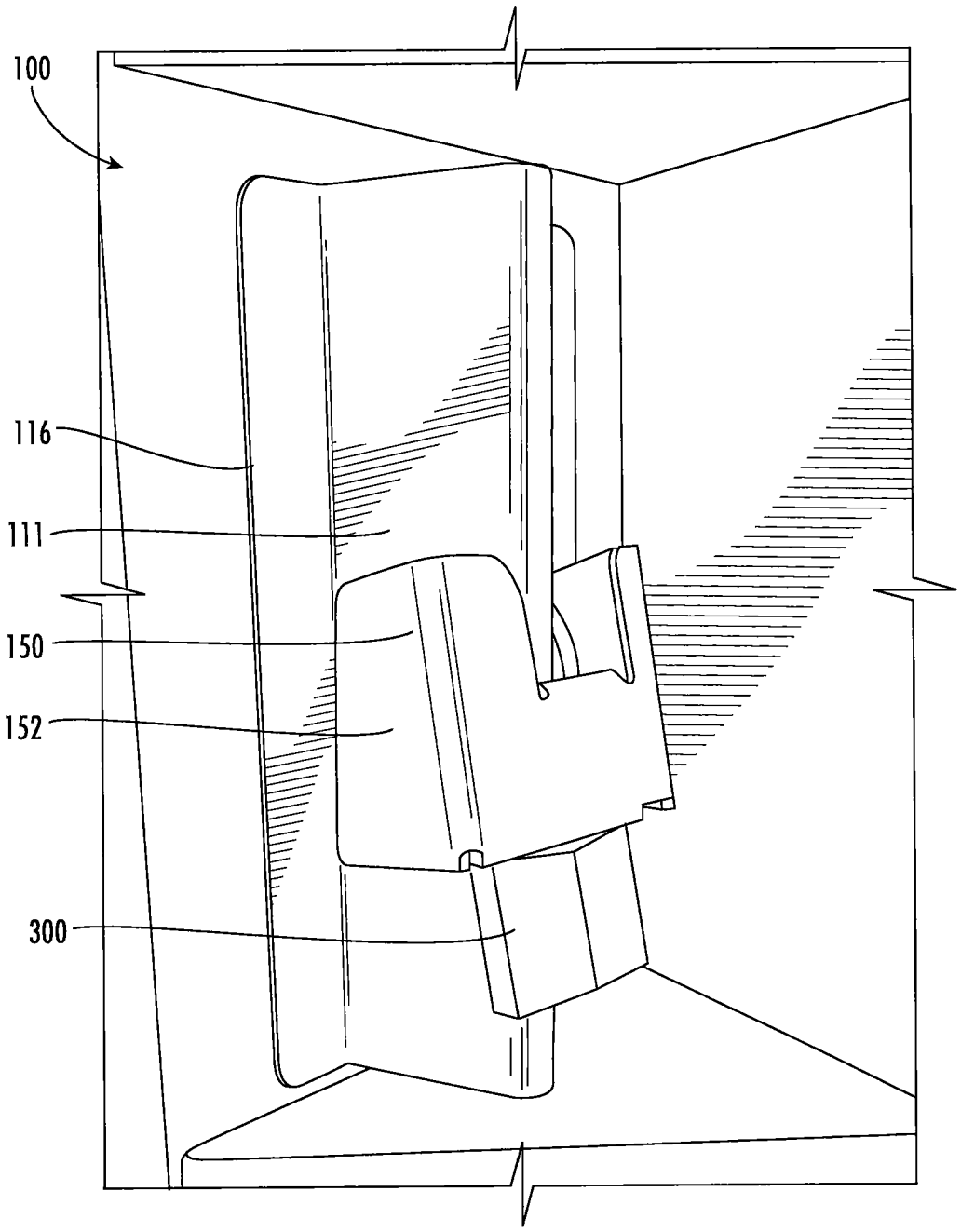
FIG. 12 is a perspective view of the theft deterrent system of FIG. 10.

Some embodiments of the present inventive concepts include, in addition to the handle cover 110, a shackle cover 150. FIG. 6 is a right-front-top isometric view of the shackle cover 150. FIG. 7 is a left-front-top isometric view of the shackle cover 150. FIG. 8 is a back isometric view of the shackle cover 150. FIG. 9 is a top view of the shackle cover 150, with the front of the shackle cover 150 facing toward the bottom edge of the page. FIG. 10 is a front view of a theft deterrent system 100 comprising a handle cover 110 and a shackle cover 150. FIG. 11 is a side view of the theft deterrent system 100 comprising the handle cover 110 and the shackle cover 150. FIG. 12 is a perspective view of the theft deterrent system 100 comprising the handle cover 110 and the pad shackle lock cover 150.

Referring to FIGS. 6-9, the shackle cover 150 may be manufactured as a unitary body using any suitable manufacturing process, and may be manufactured preferably of steel (e.g., 0.090 galvanized steel which in some embodiments may be powder coated), although other materials having contextually appropriate properties may be considered and utilized by those of skill in the art. The shackle cover 150 may include a front wall 151 and outer walls 152, which may each include a back edge 158 that is angled with respect to the front wall 151. As best seen in FIGS. 8 and 9, the shackle cover 150 may include an upper tab 154 having a shackle slot 156 therein. The shackle cover 150 may further include a lower tab 164 having a shackle slot 166 therein that is dimensioned similarly to and aligned with the shackle slot 156 of the upper tab 154. As seen in FIGS. 8 and 9, the shackle slots 156 and 166 may have a substantially "U" shape (that is, the shackle slots 156 and 166 may be open to a side of their respective tabs, which as shown here may be toward the right side of the shackle cover 150). The shackle slots 156 and 166 may be dimensioned to partially surround a shackle of a padlock (e.g., the shackle 304 of the padlock 300 of FIG. 2). The lower tab 164 may further include a through-hole 168 therein that is dimensioned to receive a shackle of a padlock (e.g., the shackle 304 of the padlock 300 of FIG. 2).

As best seen in FIG. 9, a width (along the left-right axis of the shackle cover 150) of the upper tab 154 may be less than a width of the lower tab 164. The widths may be selected to provide the appropriate spacing between the shackle slots 156 and 166 and the through-hole 168 such that the features may receive the shackle (e.g., such that shackle slots 156 and 166 may receive the shackle heel 306, and such that the through-hole 168 may receive the shackle toe 308).

The shackle cover 150 may be open to the rear; that is, there may be no rear surface between the rear edges 158 of the outer walls 152. The front wall 151 of the shackle cover 150 may be dimensioned such that an area above the upper tab 154 is open, as best seen in FIGS. 9 and 10. Accordingly, a height of the shackle cover 150 may be greater along the outer walls 152 and at first portion 153 and second portion 155 of the front wall 151 than a height of the shackle cover 150 at the upper tab 154. As best seen in FIG. 10, these dimensions may reduce or prevent exposure of the shackle 304 of the padlock 300 from exposure. In particular, with reference to FIG. 10, the left outer wall 152 and the first portion 153 of the front wall 151 reduce exposure of the shackle 304 on a side of the padlock 300 further from a wall of the pocket 214 that extends parallel to the long axis of the handle cover 110 (e.g., the wall of the pocket 214 located on the right-hand side of FIG. 10). In some embodiments, a surface area of the first portion 153 of the front wall 151 may be greater than a surface area of the second portion 155 of the front wall 151.

The shackle cover 150 may be dimensioned such that when the theft deterrent system 100 comprising the shackle cover 150 and the handle cover 110 is installed on a cabinet 200 using a padlock 300, the upper tab 154 of the shackle cover 150, when the shackle cover 150 is lowered into installation position relative to the handle cover 110, may abut an upper edge of the opening 114. Further, as seen in FIGS. 11 and 12, the angle of the back edges 158 of the outer walls 152 is such that, when the shackle cover 150 is in installation position, the back edges 158 run roughly parallel with the tabs 116 of the handle cover 110.

Although the through-hole 168 and shackle slots 156 and 166 of the shackle cover 150, and the through-holes 112 of the handle cover 110 are illustrated herein to be circular or semi-circular in shape (e.g., dimensioned to receive a shackle having a circular cross-section), other shapes of such features are within the scope of the present disclosure. For example, where the shackle 304 sought to be used to protect a cabinet 200 has a square or rectangular cross-section, those of skill in this art will appreciate that corresponding dimensions or shapes in the through-hole 168 and shackle slots 156 and 166 of the shackle cover 150, and the through-holes 112 of the handle cover 110, may be selected so that these features may be able to receive the shackle 304.

Figure 18:
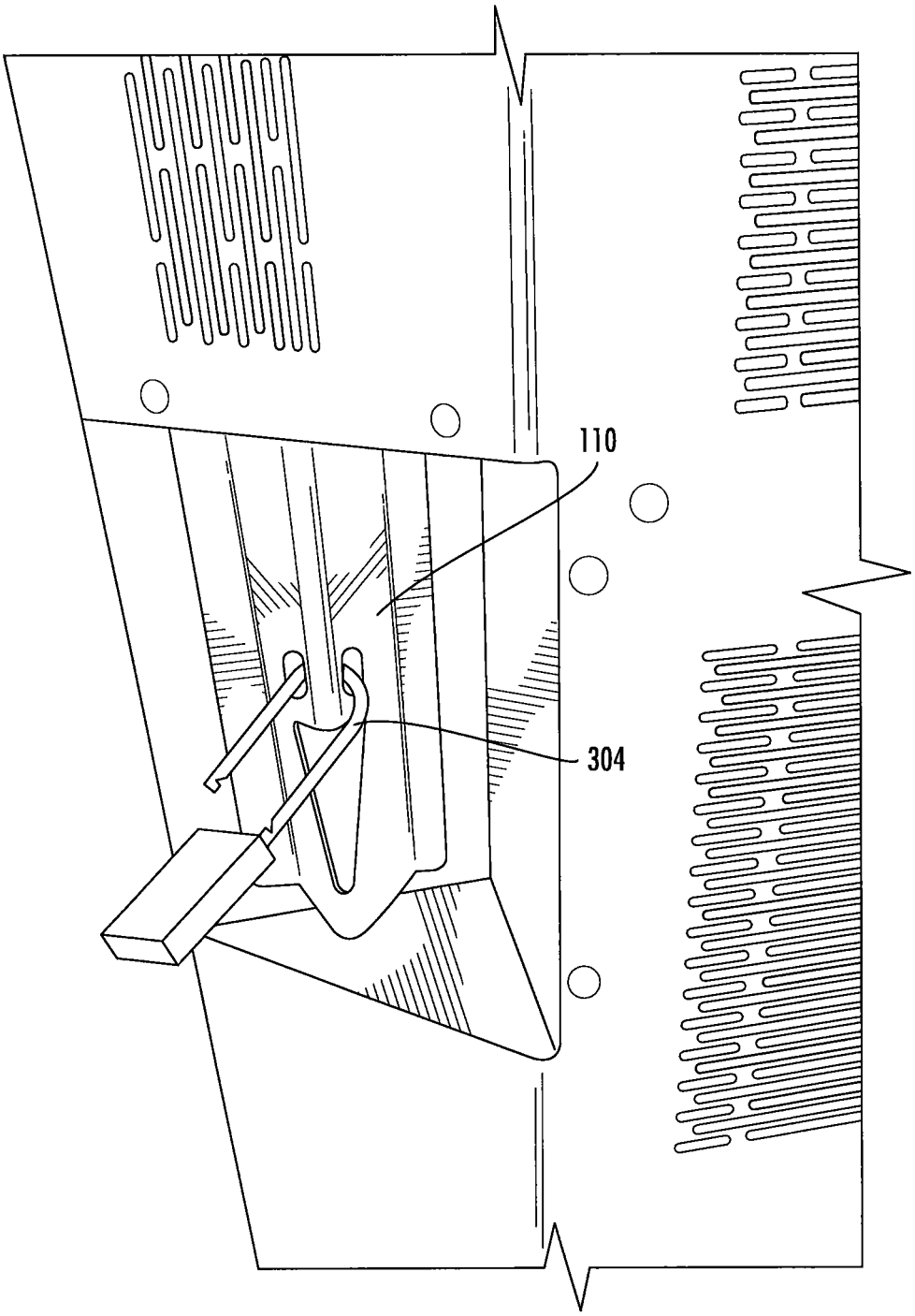
FIGS. 18-22 show various operations in a method of installing a theft deterrent system according to the inventive concepts of the present disclosure on an electronics cabinet.
Figure 19:
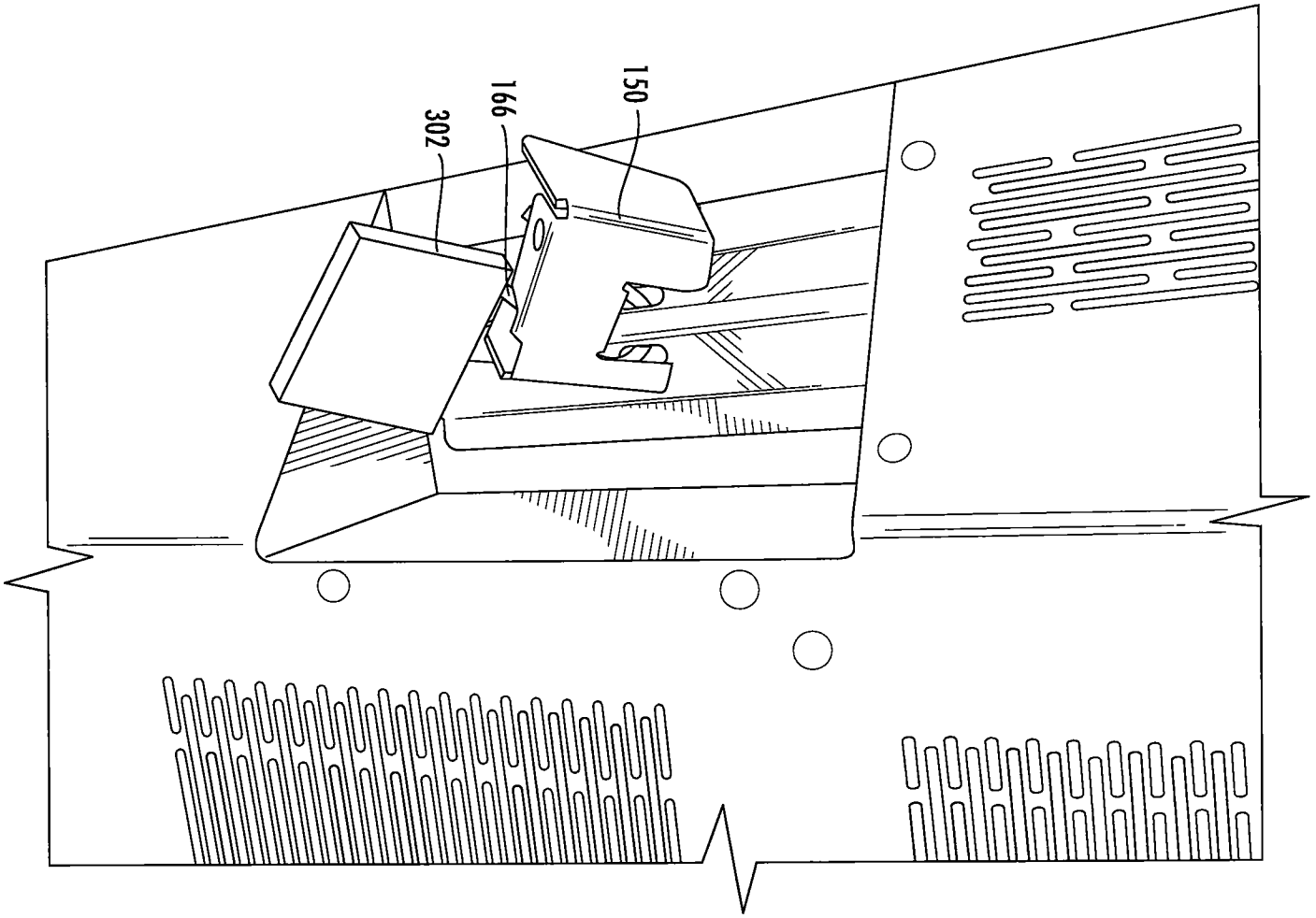
Figure 20:
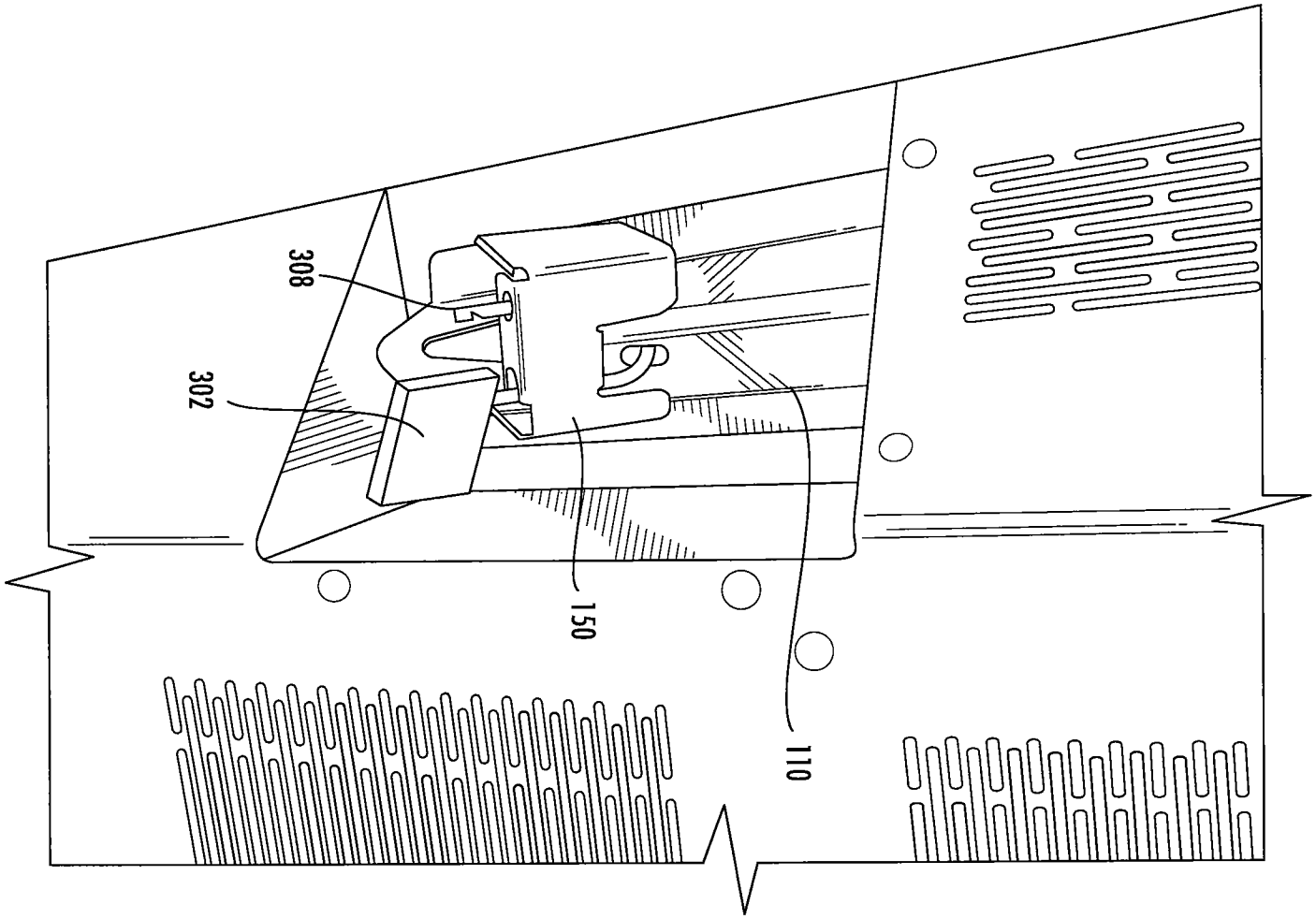
Figure 21:
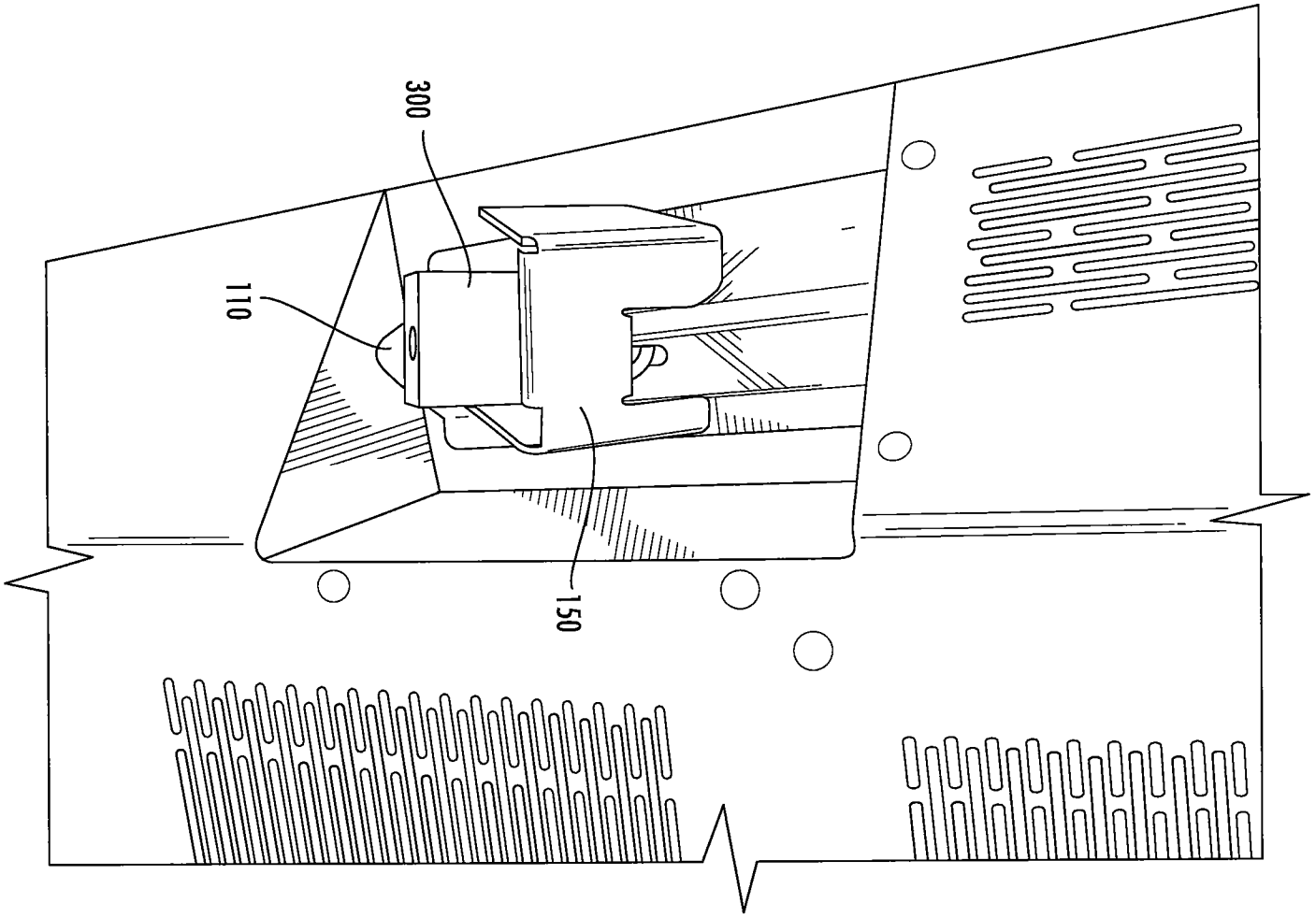
Figure 22:
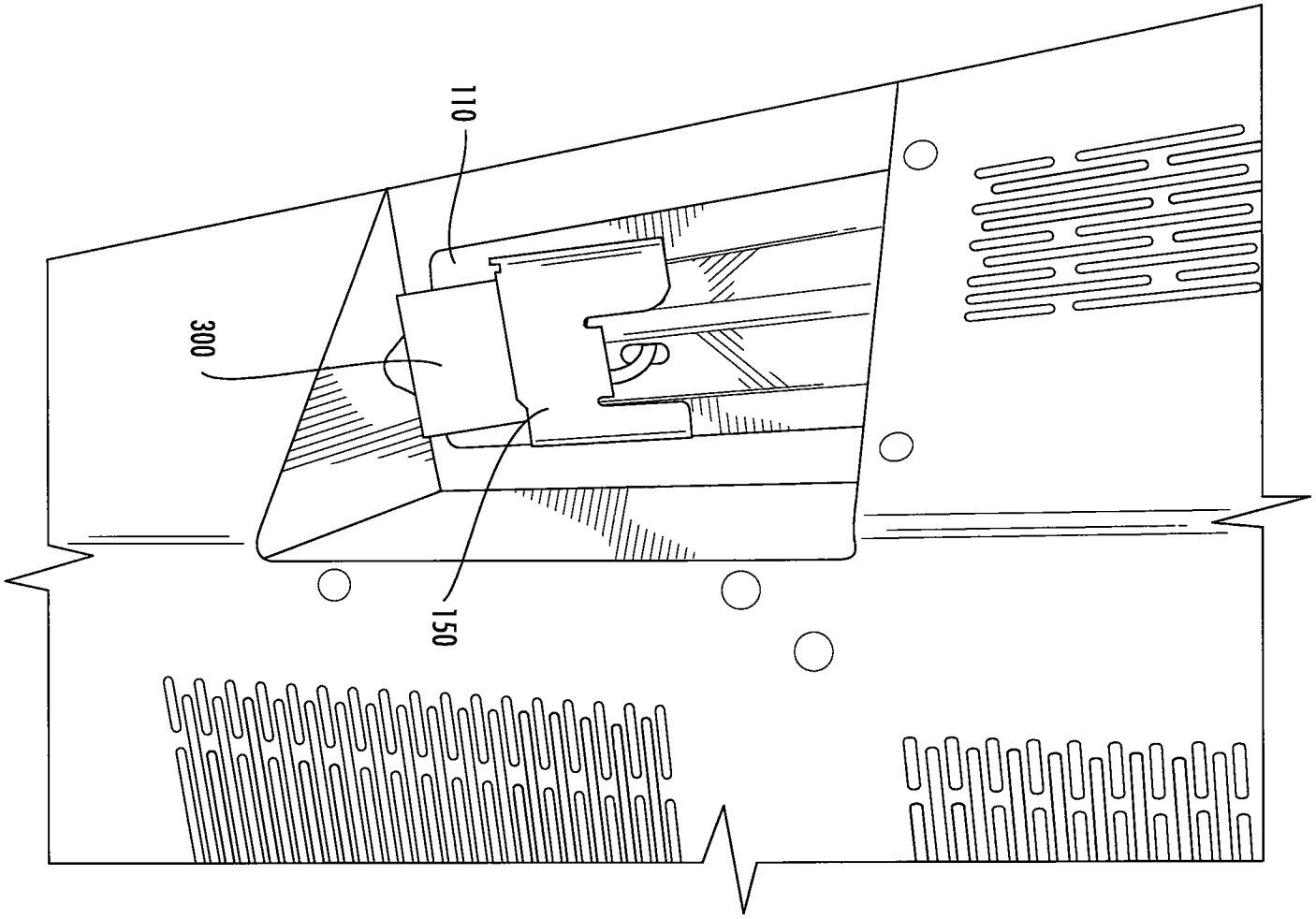

Installation of a theft deterrent system 100, and a handle cover 110 and a shackle cover 150 thereof, may proceed as shown in FIGS. 18-22. First, as shown in FIG. 18, the handle cover 110 may be positioned such that the through-holes 112 of the handle cover 110 are aligned with the through-holes of the handle 212 of the cabinet 200. The handle cover 110 may be held in place during this operation (even though the handle cover 110 might not be affixed to the handle 212 or to a surface of the cabinet 200). Then, a shackle 304 of an unlocked padlock 300 may be fed through the through-holes 112 of the handle cover 110 and the through-holes of the handle 212 (e.g., through a first through-hole 112 of the handle cover 110, then the through-holes of the handle 212, then a second through-hole 112 of the handle cover 110). Next, as shown in FIG. 19, the shackle cover 150 may be seated onto the shackle 304 of the padlock 300 by positioning the open rear side of the shackle cover 150 over the shackle 304 and sliding the shackle 304 into the shackle slots 156 and 166. Then, as shown in FIG. 20, the shackle 304 (and more particularly, the shackle toe 308 thereof) may be fed through the through-hole 168 in the lower tab 164 of the shackle cover 150. The padlock 300 may then be locked by engaging the shackle 304 with the padlock body 302 and the locking mechanism therein, as shown in FIG. 21. The shackle cover 150 may then be lowered into position into the opening 114 of the handle cover 110, such that the upper tab 154 abuts the upper edge of the opening 114, as shown in FIG. 22. Removal of the theft deterrent system 100 may proceed in a reversal of the above operations.

Depending on the configuration of the cabinet 200, and the handle 212 thereof, a "right-handed" version of the shackle cover 150 may be needed, as shown in FIGS. 6-12. The shackle cover 150 of these figures is said to be "right-handed" in that the right side of the shackle cover 150 (when viewed from the rear as in FIG. 8) is arranged such that it is opposite the wall of the cabinet 200. Absent the shackle cover 150, the padlock 300 and the shackle 304 thereof would be most likely to be attacked by a would-be thief or vandal in this area, in that the wall of the cabinet prevents or reduces access to the shackle on the "left" side of the shackle 304.

Figure 13:
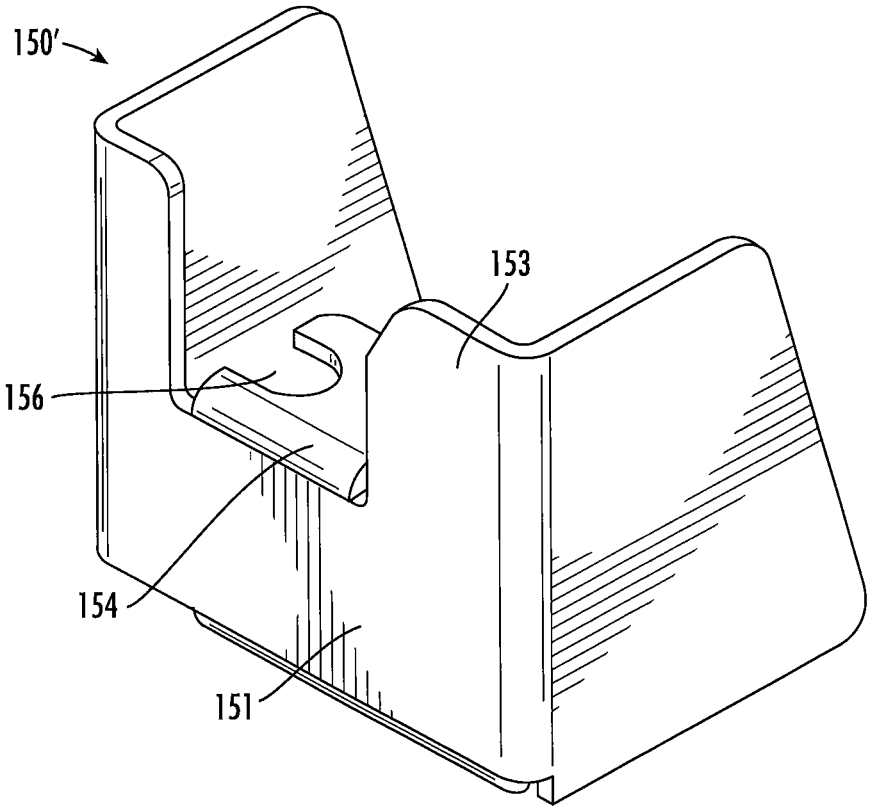
FIG. 13 is a right-front-top isometric view of a "left-handed" shackle cover.
Figure 14:
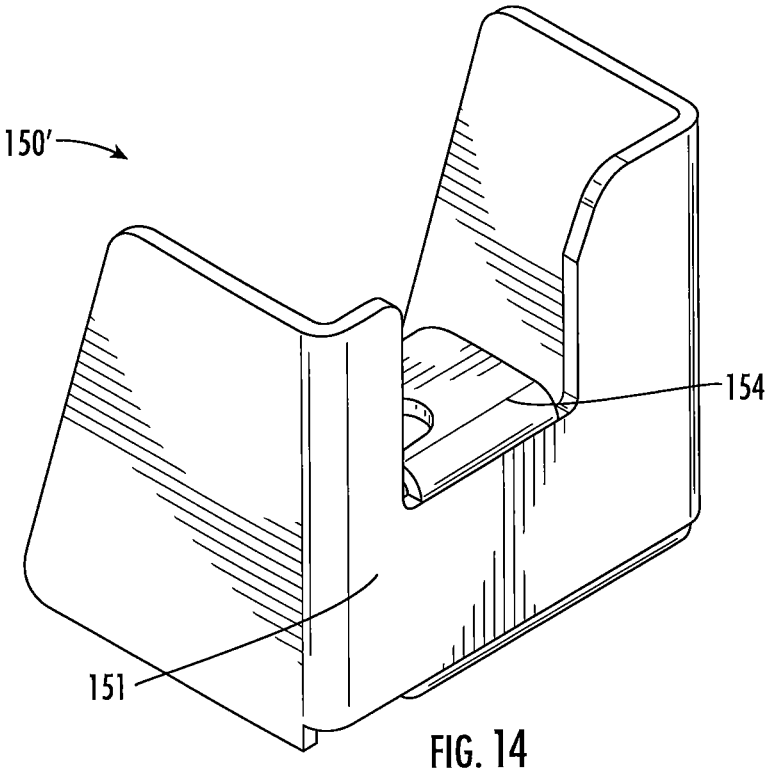
FIG. 14 is a left-front-top isometric view of the "left-handed" shackle cover of FIG. 13.
Figure 15:
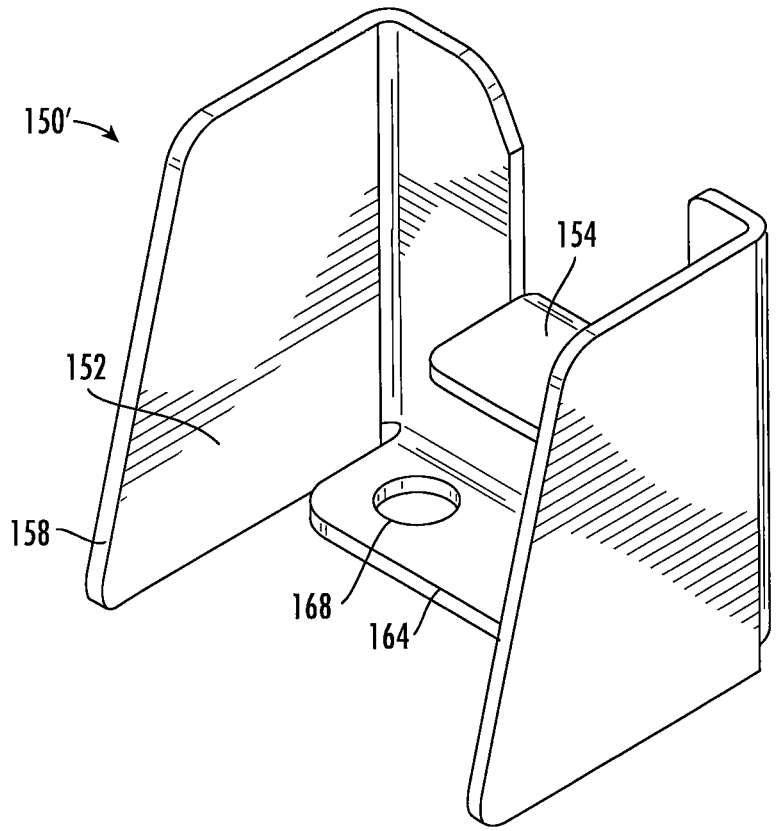
FIG. 15 is a back isometric view of the "left-sided" shackle cover of FIG. 13.
Figure 16:
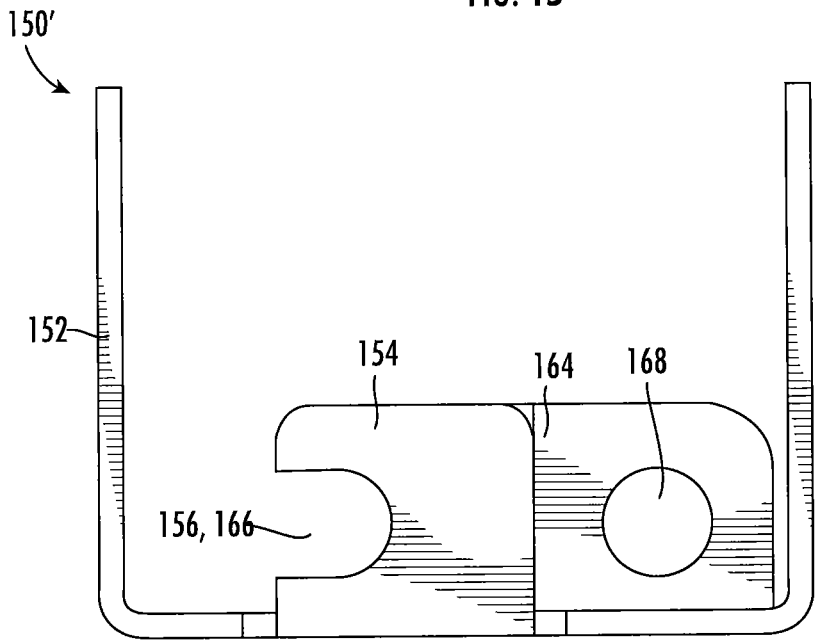
FIG. 16 is a top view of the "left-handed" shackle cover of FIG. 13.

In some embodiments, for example where a cabinet has a symmetrically opposite arrangement to the one shown in FIG. 6, a symmetrically opposite shackle cover may be desired. FIG. 13 is a right-front-top isometric view of a "left-handed" shackle cover 150'. FIG. 14 is a left-front-top isometric view of the "left-handed" shackle cover 150'. FIG. 15 is a back isometric view of the "left-sided" shackle cover 150'. FIG. 16 is a top view of the "left-handed" shackle cover 150', with the front of the shackle cover 150' facing toward the bottom edge of the page. The shackle cover 150' of these figures is said to be "left-handed" in that the left side of the shackle cover 150 (when viewed from the rear as in FIG. 15) is arranged such that it is opposite the wall of the cabinet 200. Absent the shackle cover 150', the padlock 300 and the shackle 304 thereof would be most likely to be attacked by a would-be thief or vandal in this area, in that the wall of the cabinet prevents or reduces access to the shackle on the "right" side of the shackle 304. For brevity, discussion of the features of the shackle cover 150' will be omitted herein in favor of the discussion of such features above with respect to FIGS. 6-12. In FIGS. 6-16, like reference signs refer to like components. It is noted, however, that the arrangement of features in the "left-handed" shackle cover 150' is the arrangement of the features of the "right-handed" shackle cover 150 "flipped" with respect to a longitudinal axis thereof. For example, the shackle slots 156 and 166 of the "left-handed" shackle cover 150' are open to the left side of FIG. 16, and the lower tab 164 may be positioned on the right side of the shackle cover 150', as viewed in FIG. 16.

Figure 17:
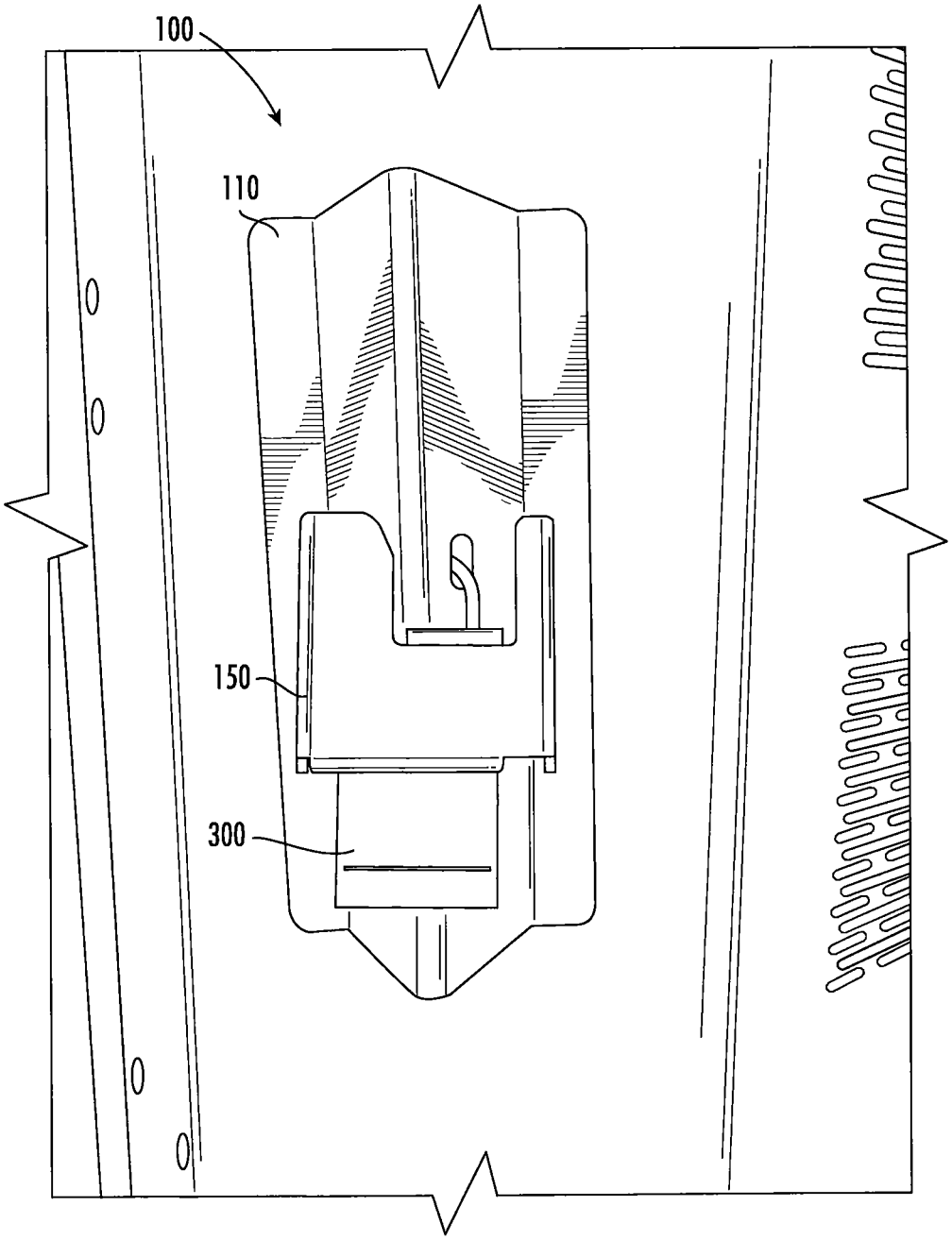
FIG. 17 is a front view of a theft deterrent system according to the inventive concepts of the present disclosure installed on a door that does not have a pocket.

As shown in FIG. 17, the theft deterrent system 100 may be arranged on a door 210 that lacks a pocket 214. In such arrangements, either the "right-handed" shackle lock 150 or the "left-handed" shackle lock 150' may be used.

In accordance with the above, parts of the theft deterrent system 100 provided herein may be mounted and secured to the cabinet 200 using only a lock (e.g., the padlock 300) and other mounting components or extra hardware may be omitted. Further, it is envisioned that no or little drilling or cutting of either the cabinet or of the components theft deterrent system 100 components may be required to install the theft deterrent system 100, as the dimensions of the padlock 300 and the shackle 304 thereof are incorporated into the design of the theft deterrent system 100. Accordingly, field installed cabinets may be updated with the theft deterrent system 100 more easily, with minimal retrofitting required.

In accordance with the present disclosure, the handle cover 110 may prevent access to an existing handle 212 and/or padlock ring thereof of a cabinet 200 and may be used to increase security. Furthermore, using a shackle cover 150 may further protect access to the handle 212 and provide additional protection to a padlock 300 to prevent damage or removal of the padlock 300 or the handle 212 using saws or cutting tools. In some embodiments, the handle cover 110 may be used without the shackle cover 150, for example, where only an increase to latch security may be needed and there may be reduced or minimal worry about access to the padlock itself. The shackle cover 150 may be used in conjunction with the handle cover 110 to secure the door handle padlock tab and the padlock itself. It is envisioned that in some embodiments the installation process may performed without any tools other than the lock itself and without any modification to an existing cabinet.

In addition to the different embodiments shown above, those of skill in this art will appreciate that other configurations may also be suitable for use. The inventive concepts being thus described, it will be apparent that the same may be varied in many ways. Such variations are not to be regarded as a departure from the spirit and scope of the inventive concepts, and all such modifications as would be obvious to one skilled in the art are to be included within the scope of the following claims.

That which is claimed is:

1. A theft deterrent system, comprising:

a handle cover comprising through-holes dimensioned to align with a through-hole in a handle of an electronics cabinet, wherein the handle cover is adapted to at least partially cover the handle, and wherein the through-holes of the handle cover are dimensioned to receive a shackle of a lock; and a shackle cover dimensioned to receive the shackle of the lock, wherein the shackle cover comprises an upper tab and a lower tab, each comprising a respective shackle slot therein dimensioned to receive the shackle of the lock, wherein each shackle slot is open toward an outer wall of the shackle cover, and wherein the lower tab further comprises a through-hole dimensioned to receive the shackle of the lock.

2. The theft deterrent system of claim 1, wherein the handle cover comprises a channel dimensioned to receive the handle of the electronics cabinet.

3. The theft deterrent system of claim 1, wherein the handle cover and the shackle cover comprise galvanized steel.

4. The theft deterrent system of claim 1, wherein the shackle cover is a unitary body.

5. The theft deterrent system of claim 1, wherein a height of the shackle cover at an outer wall is greater than a height of the shackle cover at the upper tab.

6. The theft deterrent system of claim 1, wherein the handle cover comprises an opening dimensioned to receive the upper tab when the shackle is installed on the electronics cabinet.

7. The theft deterrent system of claim 1, wherein an outer wall of the shackle cover comprises a back edge angled with respect to a longitudinal axis of the shackle cover.

8. A shackle cover having a unitary body comprising:

an upper tab and a lower tab, each comprising a respective shackle slot therein dimensioned to receive a shackle of a lock;

a through-hole in the lower tab dimensioned to receive the shackle of the lock; and outer walls, wherein a height of the shackle cover along the outer walls is greater than a height of the shackle cover at the upper tab.

9. The shackle cover of claim 8, wherein the shackle cover comprises galvanized steel.

10. The shackle cover of claim 8, wherein a front surface of the shackle cover comprises a first portion and a second portion arranged on opposite sides of the upper tab, wherein the first portion comprises a greater surface area than the second portion, and wherein the height of the first portion is greater than the height of the shackle cover at the upper tab.

11. The shackle cover of claim 10, wherein the first portion is located on a left side of the shackle cover when viewed in a front view.

12. The shackle cover of claim 10, wherein the first portion is located on a right side of the shackle cover when viewed in a front view.

13. The shackle cover of claim 8, wherein an outer wall of the shackle cover comprises a back edge angled with respect to a longitudinal axis of the shackle cover.

14. The shackle cover of claim 8, wherein the upper tab is dimensioned to seat in an opening of a handle cover.

15. The shackle cover of claim 8, wherein the shackle slots of the upper and lower tabs are substantially "U"-shaped.

16. A system comprising:

an electronics cabinet;

a handle cover comprising through-holes dimensioned to align with a through-hole in a handle of the electronics cabinet, wherein the handle cover is adapted to at least partially cover the handle, and wherein the through-holes of the handle cover are dimensioned to receive a shackle of a padlock; and a shackle cover dimensioned to receive the shackle of the padlock, wherein the shackle cover comprises an upper tab and a lower tab, each comprising a respective shackle slot therein dimensioned to receive the shackle of the padlock, wherein each shackle slot is open toward an outer wall of the shackle cover, and wherein the lower tab further comprises a through-hole dimensioned to receive the shackle of the lock.

17. The system of claim 16, further comprising the padlock.

18. The system of claim 17, wherein the handle cover, shackle cover, and padlock are located in a pocket of the electronics cabinet.

* * * * *